US012129136B2

(12) United States Patent
Chen et al.

(10) Patent No.: US 12,129,136 B2
(45) Date of Patent: Oct. 29, 2024

(54) SHEET INPUT MODULE HAVING INTERLOCKING SHEET-STOPPER STRUCTURE AND PRINTING DEVICE USING SUCH SHEET INPUT MODULE

(71) Applicant: AVISION INC., Hsinchu (TW)

(72) Inventors: Ku Ming Chen, Zhubei (TW); Ming-Shao Tang, Hukou Township, Hsinchu County (TW); Wei-Zuo Lin, Beidou Township, Changhua County (TW)

(73) Assignee: AVISION INC., Hsinchu (TW)

( * ) Notice: Subject to any disclaimer, the term of this patent is extended or adjusted under 35 U.S.C. 154(b) by 201 days.

(21) Appl. No.: 18/074,390

(22) Filed: Dec. 2, 2022

(65) Prior Publication Data

US 2023/0219774 A1 Jul. 13, 2023

(30) Foreign Application Priority Data

Jan. 13, 2022 (TW) ..... 111101437

(51) Int. Cl.
*B65H 1/18* (2006.01)
*B65H 3/06* (2006.01)

(52) U.S. Cl.
CPC ..... *B65H 1/18* (2013.01); *B65H 3/06* (2013.01); *B65H 2801/06* (2013.01)

(58) Field of Classification Search
CPC ... B65H 1/04; B65H 1/12; B65H 1/14; B65H 1/18; B65H 3/06; B65H 3/0638; B65H 3/66; B65H 3/5253; B65H 3/5261; B65H 3/5215; B65H 2402/31; B65H 2402/60; B65H 2405/324; B65H 2801/06
USPC ..... 271/10.01, 10.09, 109, 162
See application file for complete search history.

(56) References Cited

U.S. PATENT DOCUMENTS

| | | | | |
|---|---|---|---|---|
| 4,363,477 | A * | 12/1982 | Miyashita | B65H 1/04 271/170 |
| 4,456,239 | A * | 6/1984 | Yamaguchi | G03B 42/04 271/189 |
| 6,880,822 | B2 * | 4/2005 | Fukushima | B65H 3/0607 271/157 |
| 10,513,129 | B2 * | 12/2019 | Chiu | B41J 11/58 |
| 2006/0012109 | A1 | 1/2006 | Chiang | |
| 2010/0259801 | A1 | 10/2010 | Cheng | |

(Continued)

FOREIGN PATENT DOCUMENTS

| | | | |
|---|---|---|---|
| CN | 101723191 | A | 6/2010 |
| TW | M266285 | U | 6/2005 |

(Continued)

*Primary Examiner* — Leslie A Nicholson, III
(74) *Attorney, Agent, or Firm* — Muncy, Geissler, Olds & Lowe, P.C.

(57) ABSTRACT

A sheet input module includes: a tray; a support plate pivotally disposed on the tray to form a first included angle with the tray, wherein the support plate supports multiple sheets; and a sheet-stopper structure being pivotally disposed on the tray and providing a stopping function for the sheets. In an interlocking mode, the sheet-stopper structure is driven by the support plate according to a change of the first included angle and rotated relatively to the tray to adjust a second included angle between a stopping surface of the sheet-stopper structure and the sheets. A printing device using the sheet input module is also provided.

14 Claims, 7 Drawing Sheets

(56) References Cited

U.S. PATENT DOCUMENTS

| | | | |
|---|---|---|---|
| 2019/0386589 | A1 | 12/2019 | Cheng et al. |
| 2021/0309481 | A1 | 10/2021 | Shimada et al. |

FOREIGN PATENT DOCUMENTS

| | | | |
|---|---|---|---|
| TW | 201607774 | A | 3/2016 |
| TW | 202002497 | A | 1/2020 |

* cited by examiner

SHEET INPUT MODULE HAVING INTERLOCKING SHEET-STOPPER STRUCTURE AND PRINTING DEVICE USING SUCH SHEET INPUT MODULE

CROSS-REFERENCE TO RELATED APPLICATIONS

This application claims priority of No. 111101437 filed in Taiwan R.O.C. on Jan. 13, 2022 under 35 USC 119, the entire content of which is hereby incorporated by reference.

BACKGROUND OF THE INVENTION

Field of the Invention

This disclosure relates to a sheet input module and a printing device using such sheet input module, and more particularly to a sheet input module having an interlocking sheet-stopper structure and a printing device using such the sheet input module.

Description of the Related Art

In each of current image forming apparatuses, such as a printer, a multi-function peripheral, a copier and the like, a sheet input module is provided to accommodate multiple sheets or media to be printed out. The sheet input module includes a tray, a separation roller, a friction pad and a sheet support plate. One stack of sheets are stored in the tray. The separation roller and the friction pad cooperate with each other to perform the sheet separation function and prevent multiple sheets from being transported past a nip between the separation roller and the friction pad. The sheet support plate supports the stack of sheets, and is rotatable relatively to the tray. When a lot of sheets are placed on the sheet support plate, the sheet support plate is almost in a horizontal state. When a few sheets are left on the sheet support plate, the sheet support plate is in an inclined state. Therefore, the sheets on the sheet support plate in the two states have different contact angles with respect to the friction pad, so that the multi-feed drawback is present in the inclined state.

Therefore, how to avoid the above-mentioned drawback and solve the multi-feed problem caused by different states is indeed a problem to be solved in this disclosure.

BRIEF SUMMARY OF THE INVENTION

It is therefore an objective of this disclosure to provide a sheet input module having an interlocking sheet-stopper structure and a printing device using such the sheet input module, wherein adaptive adjustments of sheet stopping and guiding conditions under different states of a high sheet count and a low sheet count are made using an interlocking sheet-stopper structure to solve multi-feed problems under the different states.

To achieve the above-identified objective, this disclosure provides a sheet input module including: a tray; a support plate pivotally disposed on the tray to form a first included angle with the tray, wherein the support plate supports multiple sheets; and a sheet-stopper structure being pivotally disposed on the tray and providing a stopping function for the sheets. In an interlocking mode, the sheet-stopper structure is driven by the support plate according to a change of the first included angle and rotated relatively to the tray to adjust a second included angle between a stopping surface of the sheet-stopper structure and the sheets.

This disclosure also provides a printing device including: the sheet input module; a printing module printing data on one of the sheets coming from the sheet input module; a discharge tray storing the sheet coming from the printing module; and a transporting mechanism transporting the sheet from the sheet input module past the printing module and to the discharge tray.

With the above-mentioned embodiments, the sheet-stopper structure interlocking with the support plate can be utilized to adjust an entry angle of the sheet to adapt the entry angle to different states of high and low sheet counts, and to achieve effects of pre-stopping the sheets and facilitate the sheet separation operation.

In order to make the above-mentioned content of this disclosure more obvious and be easily understood, preferred embodiments will be described in detail as follows in conjunction with the accompanying drawings.

DETAILED DESCRIPTION OF THE INVENTION

Figure 1:
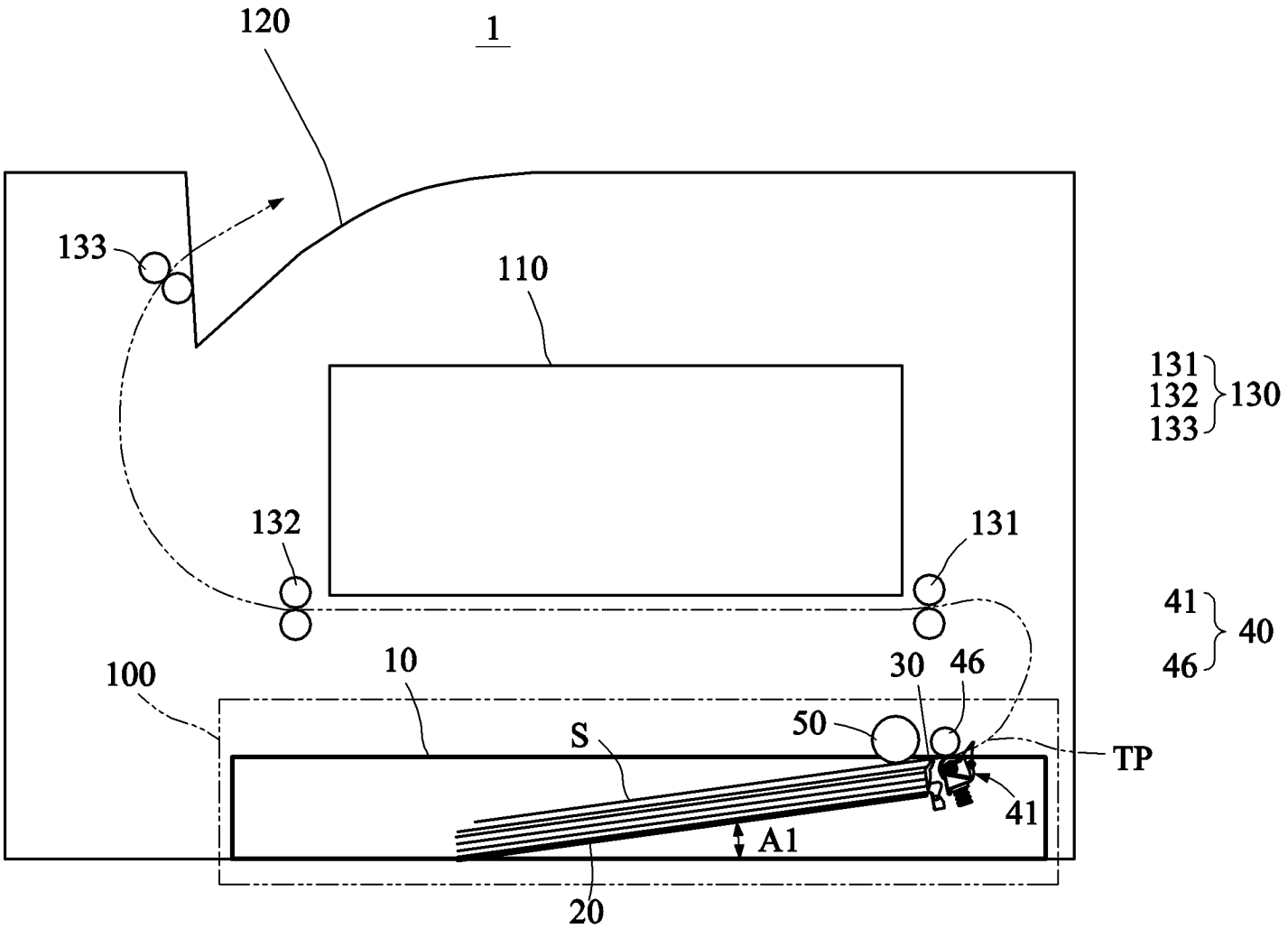
FIG. 1 is a schematic view showing a printing device according to a preferred embodiment of this disclosure.

FIG. 1 is a schematic view showing a printing device 1 according to a preferred embodiment of this disclosure. Referring to FIG. 1, the printing device 1 of this embodiment includes a sheet input module 100, a printing module 110, a discharge tray 120 and a transporting mechanism 130. The transporting mechanism 130 includes multiple rollers 131, 132 and 133. The sheet input module 100 stores multiple sheets S, and cooperates with the transporting mechanism 130 to transport the sheets S to the printing module 110 one by one, so that the printing module 110 can print data on one of the sheets S coming from the sheet input module 100. The discharge tray 120 stores the sheet S coming from the printing module 110. That is, the transporting mechanism 130 transports the sheet S printed with the data from the sheet input module 100 past the printing module 110 and to the discharge tray 120. The printing module 110 may be a simplex printing module of performing simplex printing, and may also be a duplex printing module of performing duplex printing in conjunction with the transporting mechanism 130. The printing module 110 includes, for example but without limitation to, a laser printing module, an ink-jet printing module, a dot-matrix type printing module or a thermal induction type printing module.

Figure 2:
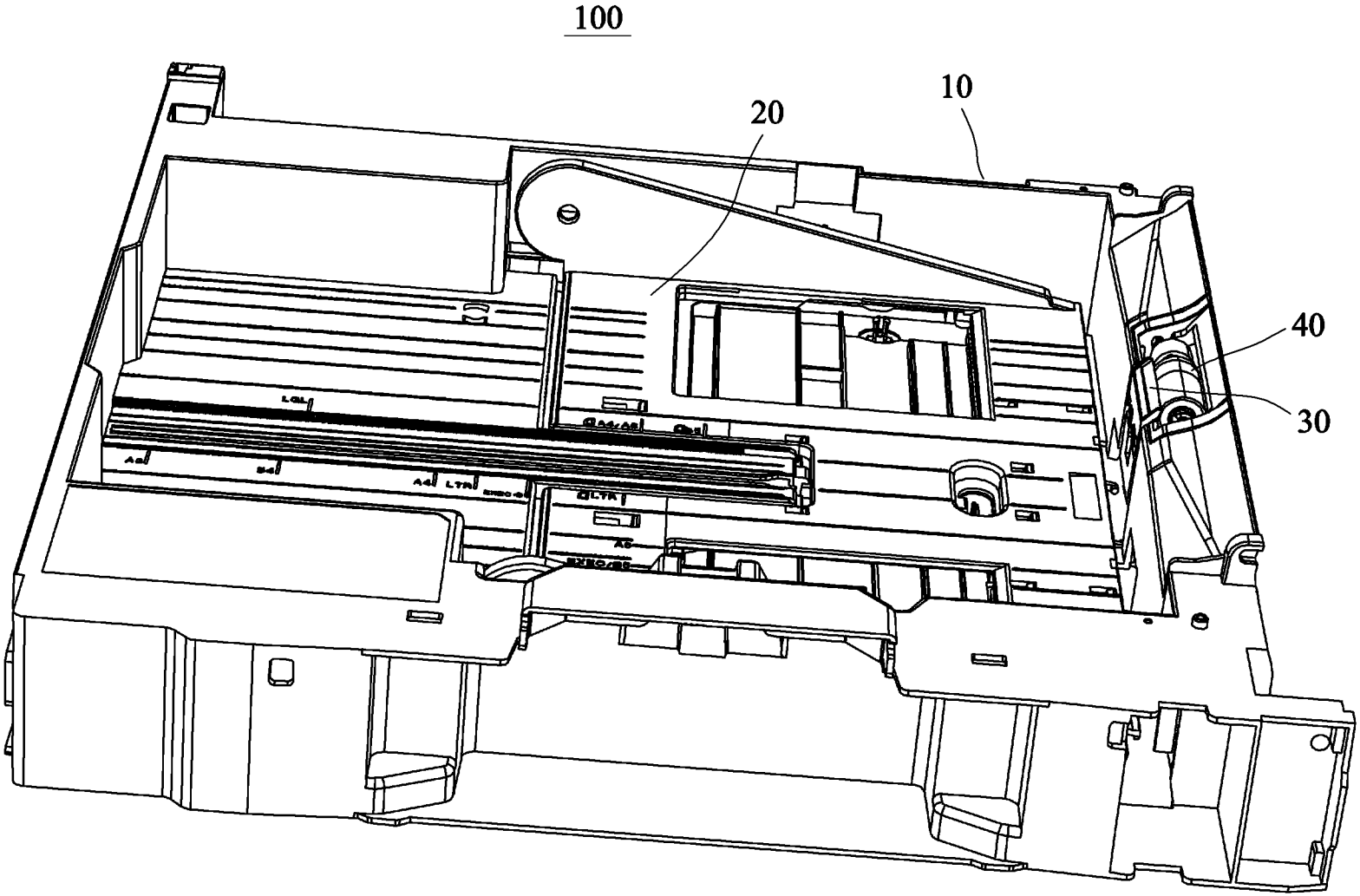
FIG. 2 is a pictorial view showing a first state of a tray of FIG. 1.
Figure 3:
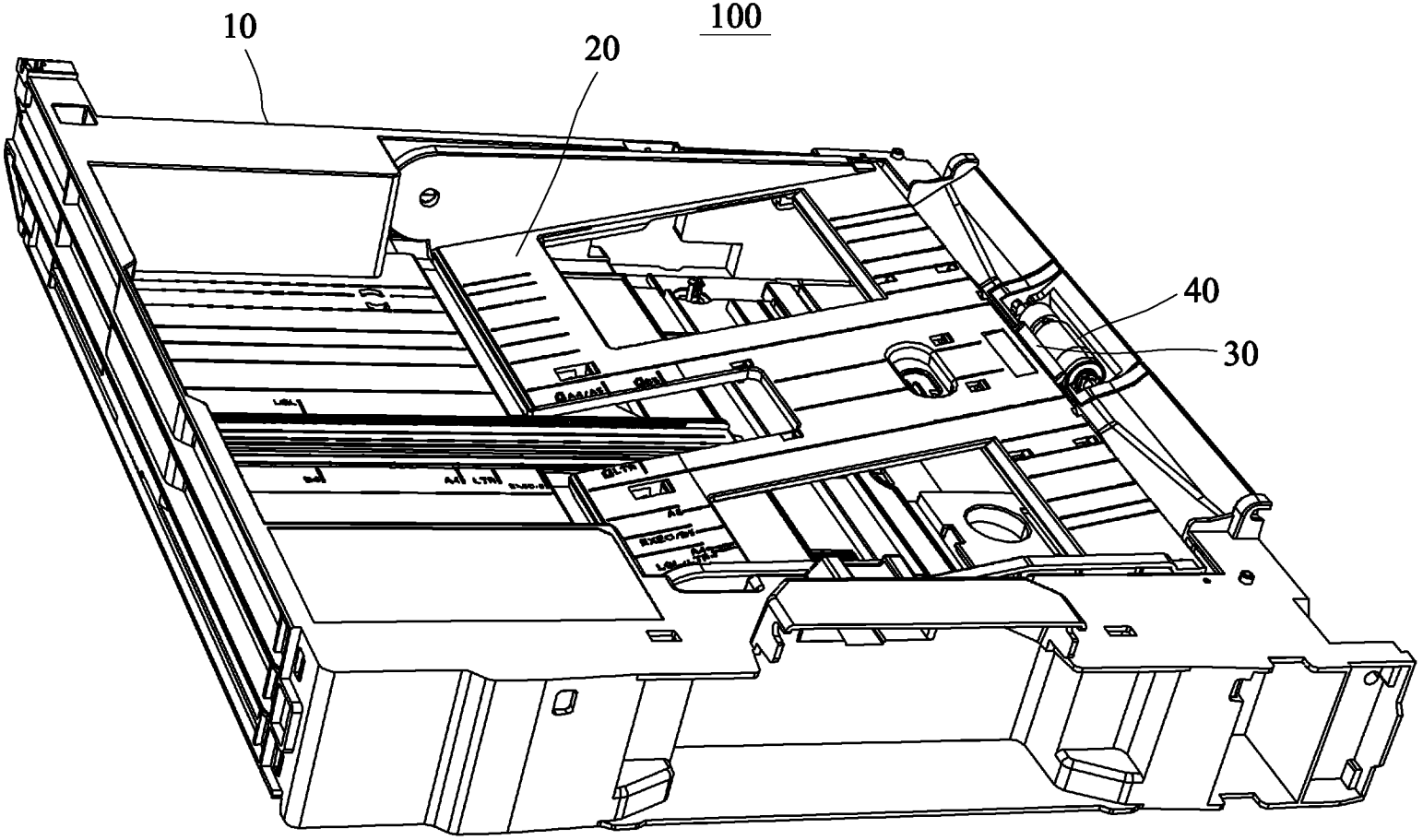
FIG. 3 is a pictorial view showing a second state of the tray of FIG. 1.

FIGS. 2 and 3 are pictorial views showing a first state and a second state of a tray of FIG. 1, respectively. Referring to FIGS. 1 to 3, the sheet input module 100 includes a tray 10, a support plate 20 and a sheet-stopper structure 30. The tray 10 stores the sheets S. The support plate 20 is pivotally disposed on the tray 10 to form a first included angle A1 with the tray 10. The support plate 20 supports the sheets S. For example, the support plate 20 supports the right half parts of the sheets S, and the tray 10 supports the left half parts of the sheets S. The sheet-stopper structure 30 is pivotally disposed on the tray 10, and provides the stopping function for the sheets S and the function of stopping the sheets S from entering a sheet transporting passage TP.

Figure 4:
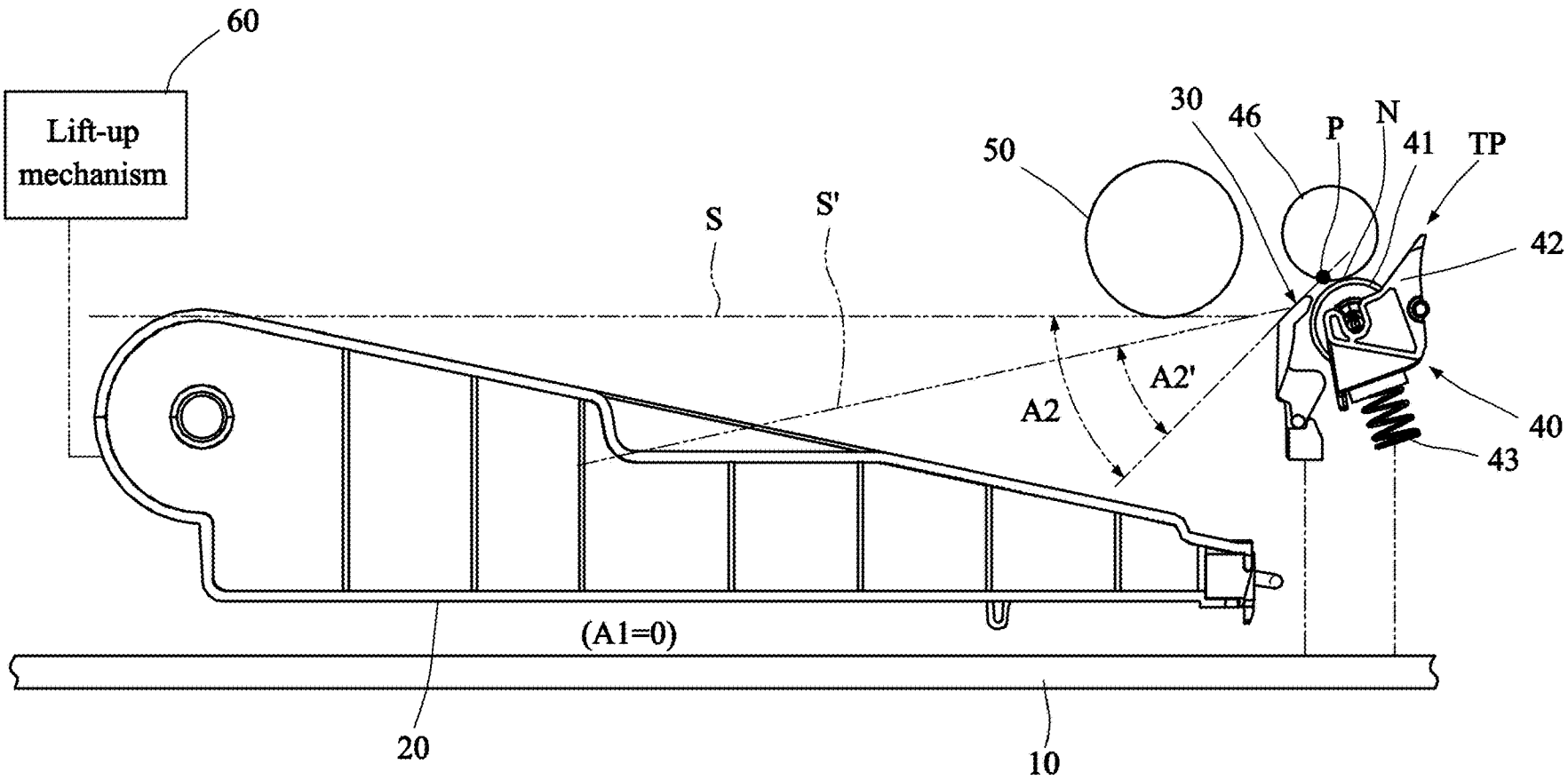
FIG. 4 is a schematic partial front view showing the first state of the tray of FIG. 1.
Figure 5:
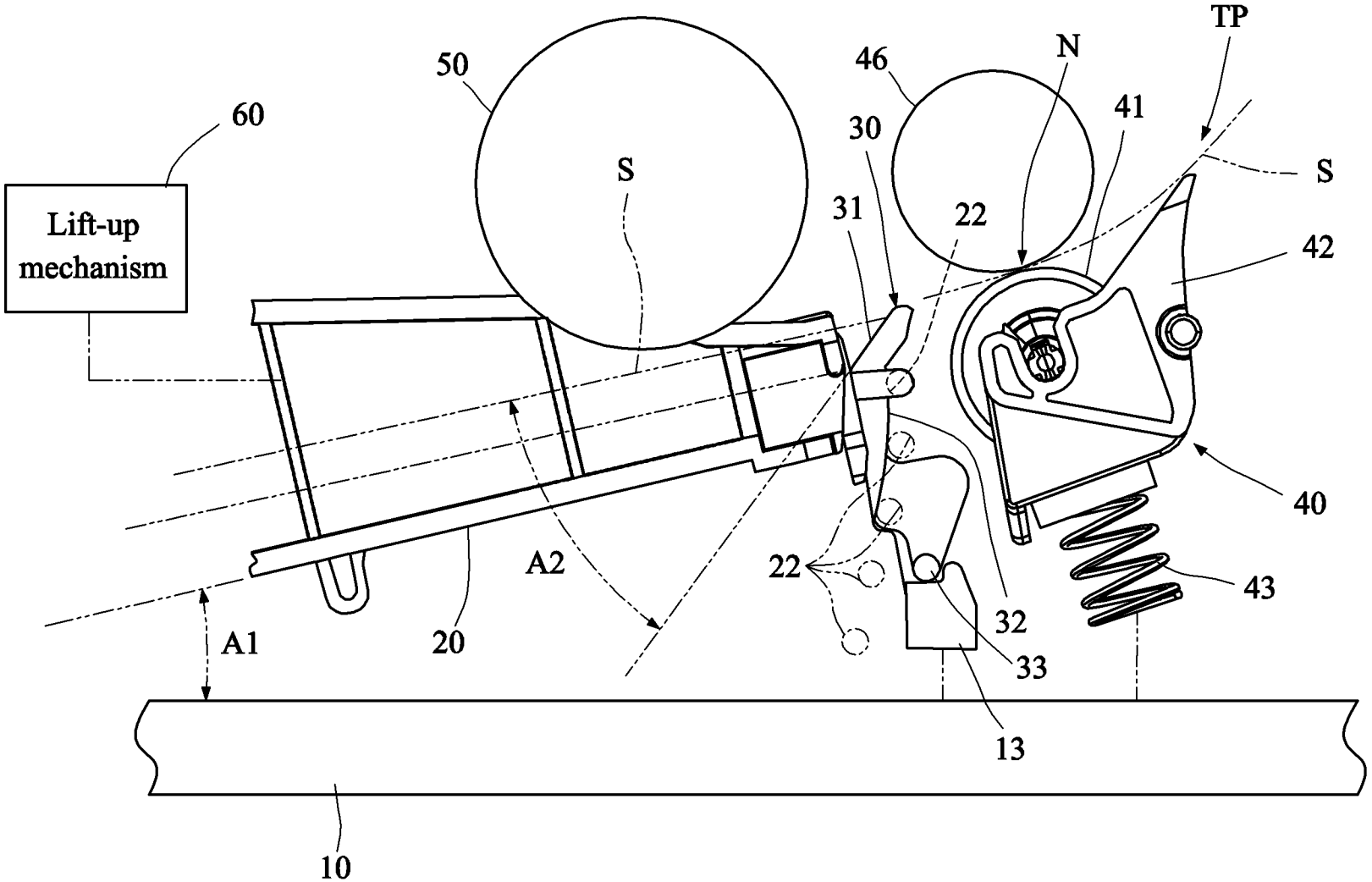
FIG. 5 is a schematic partial front view showing the second state of the tray of FIG. 1.

FIGS. 4 and 5 are schematic partial front views showing the first and second states of the tray 10 of FIG. 1, respectively. Referring to FIGS. 1, 3 and 5, when the first included angle A1 is greater than or equal to a predetermined angle (the quantity of the sheets S is smaller than a predetermined quantity), an interlocking mode (or linking or connecting mode) is entered, and the sheet-stopper structure 30 is driven by the support plate 20 according to a change of the first included angle A1 and rotated relatively to the tray 10 to adjust a second included angle A2 between a stopping surface 31 of the sheet-stopper structure 30 and the sheets S. Referring to FIGS. 2 and 4, when the first included angle A1 is smaller than the predetermined angle (the quantity of the sheets S is greater than the predetermined quantity), a disconnecting mode is entered. In the disconnecting mode, the sheet-stopper structure 30 is not driven by the support plate 20 and is not rotated relatively to the tray 10.

Referring to FIGS. 4 and 5, the sheet input module 100 may optionally further include a separation assembly 40 and a pick-up roller 50. The separation assembly 40 is disposed downstream of the sheet-stopper structure 30 to provide a sheet separating function for a portion of the sheets S passing through the sheet-stopper structure 30. The pick-up roller 50 is disposed upstream of the sheet-stopper structure 30 and drives one or multiple ones of the sheets S to move toward the sheet-stopper structure 30. The separation assembly 40 includes a friction element 41 and a separation roller 46. The separation roller 46 directly contacts one of the sheets S. The friction element 41 directly contacts another one of the sheets S to provide the sheet separating function. The separation roller 46 is disposed on the friction element 41, which is a friction roller. In another example, however, the friction element 41 is a friction pad. The separation assembly 40 further includes a guide base 42 and an elastic member 43. The friction element 41 is rotatably disposed on the guide base 42, and the elastic member 43 is connected to the friction element 41 and the tray 10, and presses the friction element 41 in a direction toward the separation roller 46. The guide base 42 guides out one of the sheets S, passing through the friction element 41, with the sheet S being curved upwards.

Optionally, the sheet input module 100 may further include a lift-up mechanism 60, which lifts up the support plate 20, so that the pick-up roller 50 drives one or multiple ones of the sheets S. In one example, the lift-up mechanism 60 is an actively powered lift-up mechanism for lifting up the support plate 20 by an electric power through a motor upon sheet inputting. In another example, the lift-up mechanism 60 is a passive lift-up mechanism without active power. For example, the lift-up mechanism 60 is a spring or a torsion spring for providing a force for permanently lifting up the support plate 20 without the electric power.

Actual operation states will be explained in the following. When the quantity of the sheets S is high, the support plate 20 is almost in the horizontal state (FIG. 4). At this time, a topmost one of the sheets S is substantially in the horizontal state, and the second included angle A2 (may be referred to as an entry angle) is formed between a moving direction of the sheet S and the stopping surface 31 of the sheet-stopper structure 30. The appropriate entry angle can provide a certain friction surface area to the sheet S, and thus provide the function of pre-stopping the sheets. If two sheets S are transported past the sheet-stopper structure 30 and the appropriate entry angle is formed between a combination of the two sheets S, and a nip portion N between the separation roller 46 and the friction element 41, then the separation roller 46 and the friction element 41 provide the sheet separation function, and only the topmost sheet S can be transported past the nip portion N. Thus, a curved guide structure of the guide base 42 guides the sheet S upwards and into the sheet transporting passage TP.

When the quantity of the sheets S is low, the support plate 20 is in the inclined state (see FIG. 5). At this time, the topmost one of the sheets S is also in the inclined state, and the second included angle A2 formed between the moving direction of the sheet S and the stopping surface 31 of the sheet-stopper structure 30 can be adjusted, by the interlocking sheet stopping structure (or mechanism), to be the same as or similar to the second included angle A2 of FIG. 4. Thus, the appropriate entry angle can be provided, and the appropriate friction surface area can be provided to the sheet S so that the pre-stopping function is obtained. If two sheets S are transported past the sheet-stopper structure 30 and the appropriate entry angle is formed between the nip portion N and the combination of the two sheets S, then the separation roller 46 and the friction element 41 provide the sheet separation function, so that only the topmost sheet S can be transported past the nip portion N and guided, by the curved guide structure of the guide base 42, upwards and into the sheet transporting passage TP, and the sheet S can enter the nip portion N smoothly, thereby guaranteeing the normal subsequent transporting or sheet separating function. On the contrary, if the sheet-stopper structure 30 is not linked with the rotation angle of the support plate 20, then the sheet enters the sheet-stopper structure 30 in the direction of the sheet S' shown in FIG. 4, so that the sheet S' is almost parallel with the stopping surface 31 of the sheet-stopper structure 30 (e.g., an included angle A2' is smaller than 30 degrees), the better pre-stopping function cannot be obtained, and the sheet S' may not enter the nip portion N from the point P, for example, thereby affecting the subsequent transporting or sheet separation function.

Figure 6:
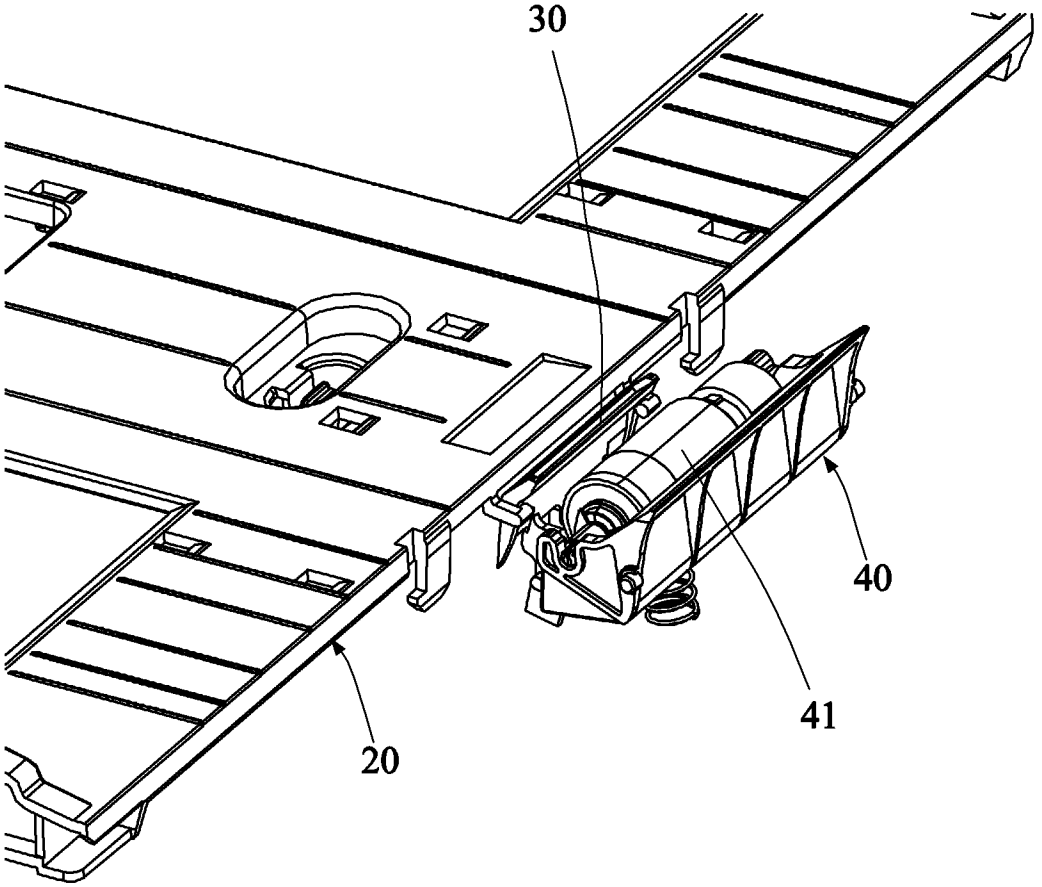
FIGS. 6 and 7 are partial pictorial views showing the tray of FIG. 3.
Figure 7:
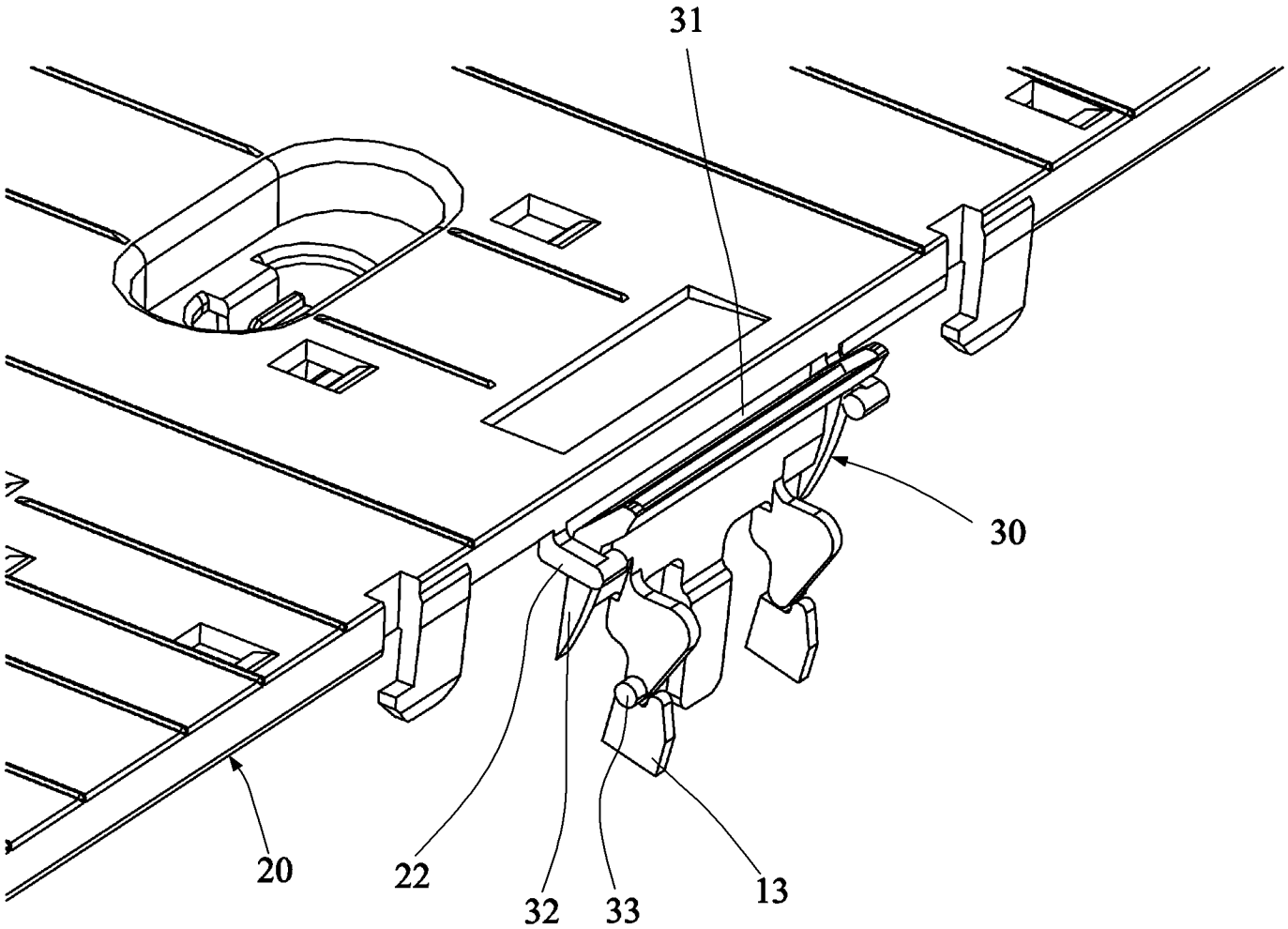

FIGS. 6 and 7 are partial pictorial views showing the tray 10 of FIG. 3. Referring to FIGS. 5 to 7, the support plate 20 includes two hooks 22. In the interlocking mode, the hooks 22 hook track parts 32 on two sides of the sheet-stopper structure 30, so that pivots 33 of the sheet-stopper structure 30 are rotated relatively to pivotal connection structures 13 of the tray 10, and the effect of controlling the interlocking or linking of the sheet-stopper structure 30 according to the rotation of the support plate 20 is achieved. From the disconnecting mode to the interlocking mode, the hook 22 is moved upwards from the bottommost position of FIG. 5, then contacts the lower portion of the track part 32, and is then moved to the uppermost portion along the track part 32. Therefore, the shape of the track part 32 can be configured to control a progressive rotation angle of the sheet-stopper structure 30, to control the entry angle of the sheet S with respect to the stopping surface 31, and to facilitate the sheet stopping operation and the sheet separation operation.

It is understandable that although the above-mentioned embodiment is described with the interlocking mode and the disconnecting mode serving as examples, other variations may also be adopted. For example, the contour of the track part 32 of the sheet-stopper structure 30 can be configured to provide no disconnecting mode. That is, the sheet-stopper structure 30 may also be always driven by the support plate 20, so that the entry angle can be adjusted in a stepless (continuous) linking manner.

With the sheet input module and the printing device of the embodiments, the sheet-stopper structure interlocking with the support plate can be utilized to adjust an entry angle of the sheet to adapt the entry angle to different states of high and low sheet counts, and to achieve the better function of pre-stopping the sheets and the better position, at which the sheet enters the separation assembly, so that the sheet separation operation can be facilitated.

The specific embodiments proposed in the detailed description of this disclosure are only used to facilitate the description of the technical contents of this disclosure, and do not narrowly limit this disclosure to the above-mentioned embodiments. Various changes of implementations made without departing from the spirit of this disclosure and the scope of the claims are deemed as falling within the following claims.

What is claimed is:

1. A sheet input module, comprising:

a tray;

a support plate pivotally disposed on the tray to form a first included angle with the tray, wherein the support plate supports multiple sheets; and a sheet-stopper structure being pivotally disposed on the tray and providing a function of stopping the sheets from entering a sheet transporting passage, wherein:

in an interlocking mode, the support plate supporting the sheets drives the sheet-stopper structure according to a change of the first included angle and rotated relatively to the tray to adjust a second included angle between a stopping surface of the sheet-stopper structure and the sheets.

2. The sheet input module according to claim 1, wherein the interlocking mode is entered when the first included angle is greater than or equal to a predetermined angle; and a disconnecting mode is entered when the first included angle is smaller than the predetermined angle, wherein in the disconnecting mode, the sheet-stopper structure is not driven by the support plate and is not rotated relatively to the tray.

3. The sheet input module according to claim 1, further comprising a separation assembly being disposed downstream of the sheet-stopper structure, and providing a sheet separating function for a portion of the sheets passing through the sheet-stopper structure.

4. The sheet input module according to claim 3, wherein the separation assembly comprises a friction element and a separation roller, the separation roller directly contacts one of the sheets, and the friction element directly contacts another one of the sheets to provide the sheet separating function.

5. The sheet input module according to claim 4, wherein the separation roller is disposed on the friction element, and the friction element is a friction roller.

6. The sheet input module according to claim 4, wherein the separation roller is disposed on the friction element, and the friction element is a friction pad.

7. The sheet input module according to claim 4, wherein the separation assembly further comprises a guide base and an elastic member, the friction element is rotatably disposed on the guide base, and the elastic member is connected to the friction element and the tray, and presses the friction element in a direction toward the separation roller.

8. The sheet input module according to claim 7, wherein the guide base guides out one of the sheets, passing through the friction element, with the sheet being curved upwards.

9. The sheet input module according to claim 3, further comprising a pick-up roller being disposed upstream of the sheet-stopper structure and driving one or multiple ones of the sheets to move toward the sheet-stopper structure.

10. The sheet input module according to claim 9, further comprising a lift-up mechanism, which lifts up the support plate so that the pick-up roller drives one or multiple ones of the sheets.

11. The sheet input module according to claim 10, wherein the lift-up mechanism is an actively powered lift-up mechanism.

12. The sheet input module according to claim 10, wherein the lift-up mechanism is a passive lift-up mechanism.

13. The sheet input module according to claim 1, wherein the support plate comprises two hooks for hooking track parts on two sides of the sheet-stopper structure in the interlocking mode.

14. A printing device, comprising:

the sheet input module according to claim 1;

a printing module printing data on one of the sheets coming from the sheet input module;

a discharge tray storing the sheet coming from the printing module; and a transporting mechanism transporting the sheet from the sheet input module past the printing module and to the discharge tray.

* * * * *